US005883618A

United States Patent [19]

Wu

[11] Patent Number: 5,883,618

[45] Date of Patent: Mar. 16, 1999

[54] COMPUTER JOYSTICK

[75] Inventor: Arthur Wu, Taipel Hsien, Taiwan

[73] Assignee: Primax Electronics. Ltd., Taiwan

[21] Appl. No.: 687,301

[22] Filed: Jul. 25, 1996

[51] Int. Cl.[6] ..... G09G 5/08

[52] U.S. Cl. ..... 345/161; 345/157

[58] Field of Search ..... 345/157, 156, 345/161, 163, 165, 166, 167

[56] References Cited

U.S. PATENT DOCUMENTS

| | | | |
|---|---|---|---|
| 5,286,024 | 2/1994 | Winblad | 345/158 |
| 5,414,444 | 5/1995 | Britz | 345/156 |
| 5,521,617 | 5/1996 | Imai et al. | 345/157 |
| 5,615,083 | 3/1997 | Burnett | 345/161 |
| 5,666,138 | 9/1997 | Culver | 345/161 |
| 5,724,068 | 3/1998 | Sanchez et al. | 345/161 |

*Primary Examiner*—Matthew Luu
*Attorney, Agent, or Firm*—Winston Hsu

[57] ABSTRACT

A computer joystick having a sliding member for measuring rotations of the joystick's control handle is disclosed. The computer joystick comprises a housing having an upper opening, a vertical control handle having a hand holding part and a ball-shaped knob having a vertical groove installed in it, a knob holding means installed under the upper opening of the housing for rotatably holding the knob of the control handle, a sliding member having an inner end, a supporting means installed in the housing for slidingly supporting the sliding member, and a measuring means for measuring movements of the sliding member wherein the inner end of the sliding member is slidably positioned within the vertical groove of the knob and the sliding member is slidably moved within the supporting means by using the vertical groove of the knob when the control handle is rotated.

10 Claims, 4 Drawing Sheets

COMPUTER JOYSTICK

BACKGROUND OF THE INVENTION

1. Field of the Invention

The present invention relates to a computer joystick, and more particularly, to the mechanical structure of a computer joystick.

2. Description of the Prior Art

Computer joysticks have been widely used in many computer game applications for controlling movement of a graphic object in a monitor screen. A joystick usually comprises a housing for holding electronic and mechanic parts in it and a vertical control handle connected to the housing for controlling the moving of an object over a monitor screen. The control handle connected to the housing is movable within a fixed angle and the moving of the object within the screen is controlled by moving the control handle in various directions. At the bottom end of the control handle a movement sensing mechanism which comprises two positioning sensors is installed for converting movements of the control handle in a two-dimensional space into corresponding control signals.

In general, most computer joysticks can only provide movement control over a two-dimensional space. But many sophisticated computer games requires three-dimensional movement control capability for controlling motions of an object in a three-dimensional environment. In order to provide a third dimension control capability, some computer joysticks provide two push buttons or a rotatable wheel installed somewhere on a joystick housing for controlling motions of an object in the third dimension. Although such designs can provide three-dimensional control capability, it is achieved by using the control handle to control motions in a two-dimensional plane and using the two push buttons or the rotatable wheel to control motions in the third dimension. Such control methods usually require using both hands or two different portions of one hand to exercise three-dimensional control motions and thus are quite complex. If the third dimension control can be provided by simply rotating the control handle, the two push buttons or the rotatable wheel can thus be eliminated and the complexity problem caused by manipulating the push buttons or the rotatable wheel can also be solved.

SUMMARY OF THE INVENTION

It is therefore a primary objective of the present invention to provide a computer joystick equipped with a rotatable control handle which can be used to provide the third dimension control capability.

Briefly, in a preferred embodiment, the present invention includes a computer joystick comprising:

a. a housing having an upper opening;

b. a vertical control handle comprising a hand holding part on its upper end and a ball-shaped knob connected under the hand holding part having a vertical groove installed in it;

c. knob holding means installed under the upper opening of the housing for rotatably holding the knob of the control handle;

d. a sliding member having an inner end;

e. supporting means installed in the housing for supporting the sliding member wherein the sliding member is horizontally and slidably supported by the supporting means; and f. measuring means for measuring movements of the sliding member inside the supporting means;

wherein the inner end of the sliding member is slidably positioned within the vertical groove of the knob and the sliding member is slidably moved within the supporting means by using the vertical groove of the knob when the control handle is rotated.

It is an advantage of the present invention that the sliding member can be used for measuring the rotation of the control handle so that the third dimension motion control of an object can be exercised by rotating the control handle.

These and other objects and the advantages of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 1:
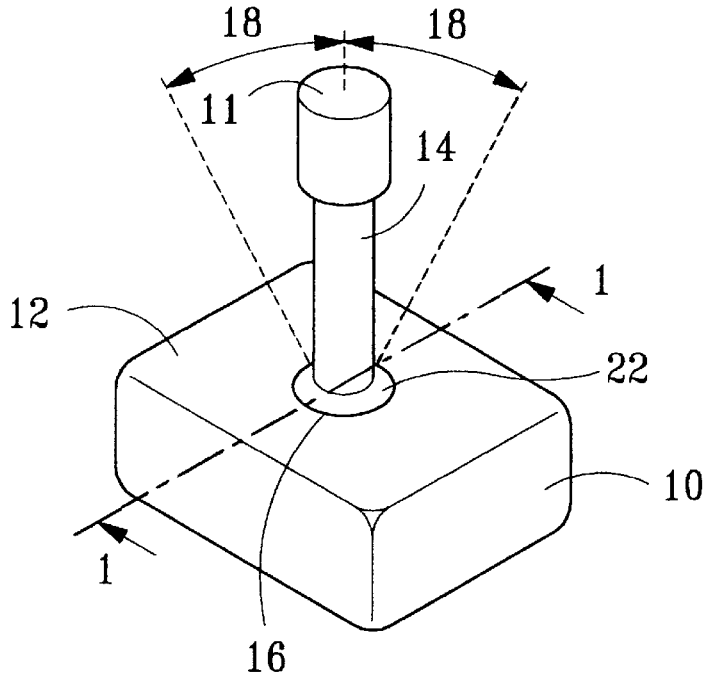
FIG. 1 is a perspective view of a computer joystick according to the present invention.

FIG. 1 is a perspective view of a computer joystick 10 according to the present invention. The joystick 10 comprises a housing 12 for holding electronic and mechanic parts in it, an upper opening 16 over the top end of the housing 12, and a vertical control handle 14 installed in the upper opening 16 of the housing 12. The control handle 14 can be tilted within a fixed angle 18 over various directions for controlling two-dimensional movements of an object in a monitor screen (not shown). It can also be rotated by hand for controlling movements of the object in a third dimension.

Figure 2:
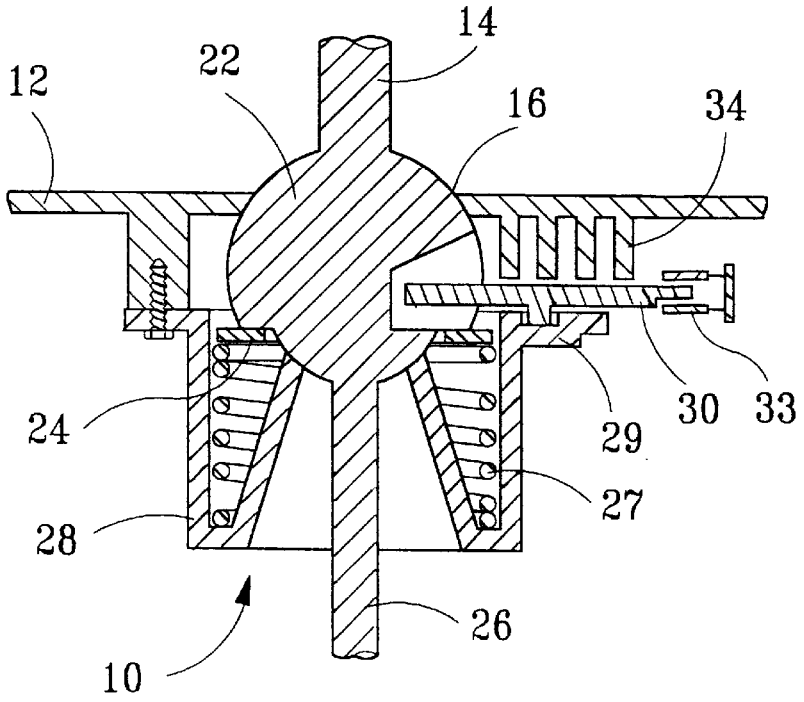
FIG.2 is a sectional view 1—1 of the computer joystick shown in FIG. 1.

Please refer to FIG. 2. FIG. 2 is a sectional view 1—1 of the computer joystick 10 shown in FIG. 1. It shows that the computer joystick 10 comprises an upper opening 16 over the upper end of the housing 12, a vertical control handle 14 having a ball-shaped knob 22 on its middle section and a shaft 26 on its lower end, a knob holding means 28, a ring-shaped washer 24, an elastic member 27 which is a spring in this embodiment, a sliding member 30, a sliding member supporting means which comprises an upper flat 34 and a lower flat 29 for slidably supporting the sliding member 30, and an optic encoder 33 for measuring movements of the sliding member 30. Details of various parts and their operations will be introduced in the following figures.

Figure 3:
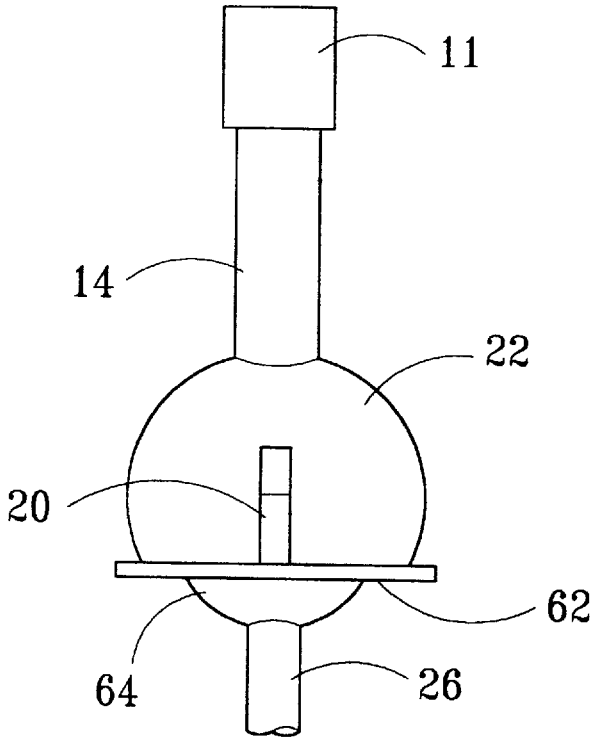
FIG. 3 is a side view of the control handle shown in FIG. 2.

FIG. 3 is a side view of the control handle 14 shown in FIG. 2. The control handle 14 comprises a hand holding part 11 on its upper end, a ball-shaped knob 22 on its middle section, and a shaft 26 on its lower end. The ball-shaped knob 22 comprises a vertical groove 20 which is installed on a vertical plane crossing the center of the ball-shaped knob 22. The vertical groove 20 is used for horizontally moving the sliding member 30 shown in FIG. 2. Detail of the operations will be explained in FIGS. 7 and 8. The lower end of the knob 22 comprises a ring-shaped cross section 62 and a downward protruding convex 64 over the center of the ring-shaped cross section 62. The cross section 62 is used for engaging the washer 24 and also the elastic member 27 shown in FIG. 2 for maintaining the control handle in an upright position. The shaft 26 is used as an actuator for interacting with a movement sensing mechanism (not shown) installed under the shaft 26 which is used for measuring movements of the shaft in a two-dimensional plane.

Figure 4:
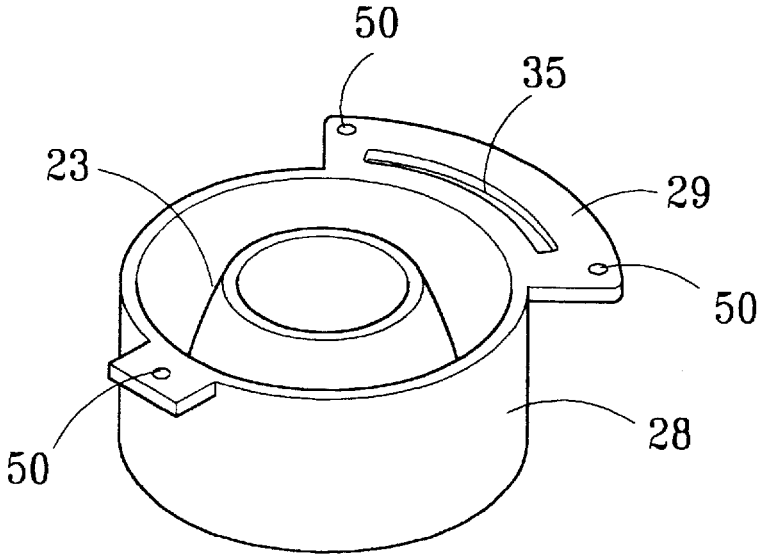
FIG. 4 is a perspective view of the knob holding means shown in FIG. 2.

Please refer to FIG. 4. FIG. 4 is a perspective view of the knob holding means 28 shown in FIG. 2. The knob holding means 28 comprises an upward protruding structure 23 with a round opening on its top end for engaging the convex 64 of the knob 22 shown in FIG. 3. It can be seen in FIG. 2 that the knob 22 is rotatably held between the upper opening 16 of the housing 12 and the round opening of the upward protruding structure 23 so that the shaft 26 of the control handle 14 can be moved by using the hand holding part 11 over the upper end of the control handle 14. And the elastic member 27 shown in FIG. 2 is installed between the protruding structure 23 of the knob holding means 28 and the cross section 62 of the knob 22 for maintaining the control handle 14 in an upright position. The lower end of the elastic member 27 is mounted outside the upward protruding structure 23 of the knob holding means 28, and its top end is stuck to the washer 24. The washer 24 is clamped between the upper end of the elastic member 27 and the cross section 62 of the knob 22 for engaging the elastic member 27. When the control handle 14 is in a tilted position, the top end of the elastic member 27 will be tilted by the washer 24, and when the control handle 14 is released, the elastic member 27 will push the control handle 14 back through the washer 24 to maintain it in an upright position.

The upper end of the knob holding means 28 further comprises three screw mounting holes 50 and a lower flat 29 which is used for supporting the sliding member 30. In FIG. 2 it can be seen that the knob supporting means 28 is mounted under the upper opening 16 of the housing 12 by using screws. The lower flat 29 comprises an arc groove 35 in it for slidingly receiving the positioning mechanism 31 of the sliding member 30 which will be shown in FIG. 5.

Figure 5:
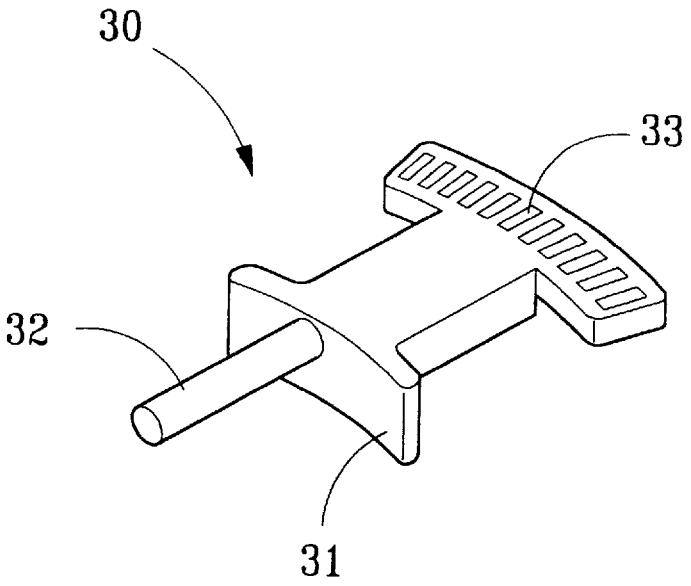
FIG. 5 is a perspective view of the sliding member shown in FIG. 2.
Figure 6:
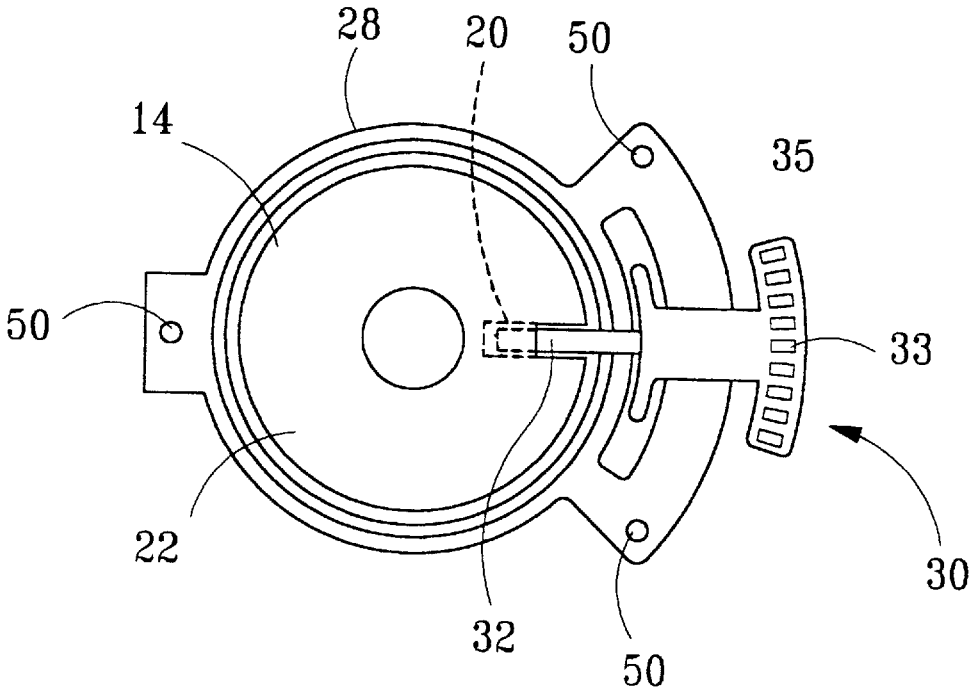
FIG. 6 is a top view of an assembly which comprises the sliding member, the control handle, and the knob holding means shown in FIG. 2.

Please refer to FIGS. 5 and 6. FIG. 5 is a perspective view of the sliding member 30 shown in FIG. 2, and FIG. 6 is a top view of an assembly which comprises the sliding member 30, the control handle 14, and the knob holding means 28 shown in FIG. 2.

The sliding member 30 comprises an inner end 32 which is a column-shaped stub, an outer end 33 having a fringe installed in it, and a positioning mechanism 31 installed in the middle of the sliding member 30. The fringe installed in the outer end 33 of the sliding member 30 is used by the optic encoder 33 shown in FIG. 2 for measuring movements of the sliding member 30 inside the arc groove 35 of the lower flat 29.

In FIG. 6 it shows that the inner end 32 of the sliding member 30 is slidably positioned within the vertical groove 20 of the knob 22 and the sliding member 30 can be slidably moved within the arc groove 35 of the lower flat 29 by using the vertical groove 20 of the knob 22 when the control handle 14 is rotated.

The sliding member supporting means shown in FIG. 2 comprises an upper flat 34 installed inside the housing 12 and a lower flat 29 installed over the upper end of the knob holding means 28 and the sliding member 30 is horizontally and slidably supported between the upper flat 34 and lower flat 29 of the supporting means. The upper flat 34 is implemented by using four plastic strips with flat lower ends installed under the plastic housing 12.

Figure 7:
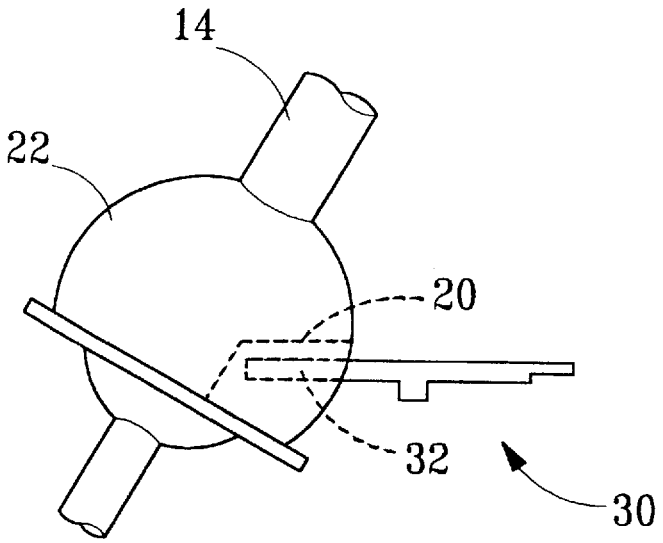
FIG. 7 shows the sliding member and the control handle which is in a tilted position.
Figure 8:
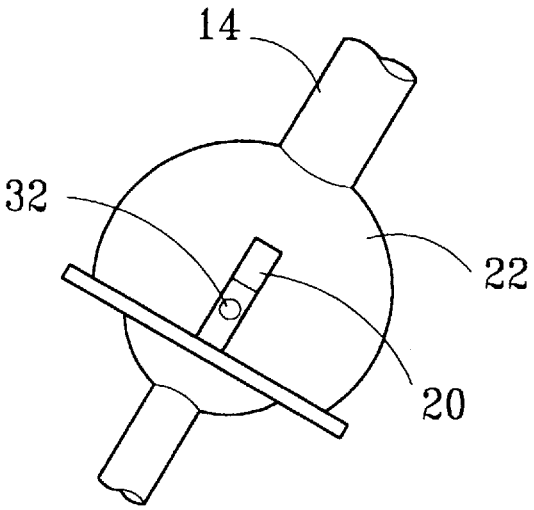
FIG. 8 is similar to FIG. 7 except that the control handle is in another tilted position.

Please refer to FIGS. 7 and 8. These two figures show how the sliding member 30 reacts when the control handle 14 is tilted in two different directions. Since the sliding member 30 is used to measure rotational movements of the knob 22 for controlling a third-dimensional movement of an object in a monitor screen, the sliding member 30 should not be moved by the knob 22 if the control handle 14 is not rotated. That means if the control handle 14 is only tilted in various directions instead of being rotated, the sliding member 30 should remain still. The vertical groove 20 of the knob 22 and the column-shaped inner end 32 of the sliding member 30 are specifically designed for achieving such effect.

The inner end 32 of the sliding member 30 is slidably positioned within the vertical groove 20 of the knob 22 and is horizontally pointed toward the center of the ballshaped knob 22. Since the vertical groove 20 of the knob 22 is installed on a vertical plane crossing the center of the ball-shaped knob 22 (see FIG. 3), the inner end 32 of the sliding member 30 will slide within the vertical groove 32 of the knob 22 when the control handle 14 is tilted toward the vertical groove 20, such as the one shown in FIG. 7. Such tilting action will not cause any horizontal movement of the sliding member 30. In FIG. 8 the control handle 14 is tilted in another direction which is 90 degrees away from the tilted direction shown in FIG. 7. Since the inner end 32 is pointed toward the center of the knob 22 and the inner end 32 itself is shaped as a round column, such tilting action will not cause any horizontal movement of the sliding member 30 either. The sliding member 30 can be horizontally moved only when the knob 22 of the control handle 14 is rotated instead of tilted.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A computer joystick comprising:

a. a housing having an upper opening;

b. a vertical control handle comprising a hand holding part on its upper end and a ball-shaped knob connected under the hand holding part having a vertical groove installed in it;

c. knob holding means installed under the upper opening of the housing for rotatably holding the knob of the control handle;

d. a sliding member having an inner end;

e. sliding member supporting means installed in the housing for supporting the sliding member wherein the sliding member is horizontally and slidably supported by the supporting means; and f. measuring means for measuring movements of the sliding member inside the supporting means;

wherein the inner end of the sliding member is slidably positioned within the vertical groove of the knob and the sliding member is slidably moved within the supporting means by using the vertical groove of the knob when the control handle is rotated.

2. The computer joystick of claim 1 wherein the sliding member further comprises an outer end and wherein the measuring means comprises an fringe installed in the outer end of the sliding member and an optic encoder installed in the housing for measuring movements of the fringe.

3. The computer joystick of claim 1 wherein the sliding member further comprises a positioning mechanism and the supporting means further comprises an arc groove for slidingly receiving the positioning mechanism of the sliding member wherein the positioning mechanism of the sliding member slides along the arc groove of the supporting means when the sliding member is slidably moved by rotating the knob of the control handle.

4. The computer joystick of claim 3 wherein the supporting means comprises an upper flat installed inside the housing and a lower flat installed over the knob holding means wherein the sliding member is slidably supported between the upper and lower flats of the supporting means.

5. The computer joystick of claim 4 wherein the arc groove is installed on the lower flat of the supporting means for slidingly receiving the positioning mechanism of the sliding member.

6. The computer joystick of claim 1 wherein the vertical groove of the knob is installed on a vertical plane crossing the center of the ball-shaped knob.

7. The computer joystick of claim 1 wherein the inner end of the sliding member is a column-shaped stub which horizontally points toward the center of the ball-shaped knob.

8. The computer joystick of claim 1 wherein the lower end of the knob comprises a ring-shaped cross section and a downward protruding convex over the center of the ring-shaped cross section and wherein the knob holding means comprises an upward protruding structure with a round opening on its top end for engaging the convex of the knob wherein the knob is rotatably held between the upper opening of the housing and the round opening of the upward protruding structure.

9. The computer joystick of claim 8 further comprising an elastic member installed between the protruding structure of the knob holding means and the cross section of the knob for maintaining the control handle in an upright position.

10. The computer joystick of claim 9 further comprising a washer clamped between the elastic member and the cross section of the knob for engaging the elastic member.

* * * * *